US012535021B2

(12) United States Patent
Oryoji et al.

(10) Patent No.: US 12,535,021 B2
(45) Date of Patent: Jan. 27, 2026

(54) INTERNAL COMBUSTION ENGINE CONTROL DEVICE AND INTERNAL COMBUSTION ENGINE CONTROL METHOD

(71) Applicant: Hitachi Astemo, Ltd., Hitachinaka (JP)

(72) Inventors: Kazuhiro Oryoji, Hitachinaka (JP); Yoshihiko Akagi, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 18/723,711

(22) PCT Filed: Jan. 12, 2022

(86) PCT No.: PCT/JP2022/000711
§ 371 (c)(1),
(2) Date: Jun. 24, 2024

(87) PCT Pub. No.: WO2023/135679
PCT Pub. Date: Jul. 20, 2023

(65) Prior Publication Data
US 2025/0059899 A1 Feb. 20, 2025

(51) Int. Cl.
*F01M 1/16* (2006.01)
*F01M 1/08* (2006.01)
*F01P 3/08* (2006.01)

(52) U.S. Cl.
CPC ..... *F01M 1/16* (2013.01); *F01M 1/08* (2013.01); *F01P 3/08* (2013.01); *F01M 2250/60* (2013.01)

(58) Field of Classification Search
CPC ..... F01M 1/16; F01M 1/08; F01M 2250/60; F01M 2001/165; F01P 3/08; F02D 41/22
See application file for complete search history.

(56) References Cited

U.S. PATENT DOCUMENTS

2017/0016364 A1* 1/2017 Kazaoka ..... F01M 1/08
2017/0363039 A1* 12/2017 Shibata ..... F01M 1/16
2021/0024070 A1* 1/2021 Honda ..... B60W 30/184

FOREIGN PATENT DOCUMENTS

JP 2002-147236 A 5/2002
JP 2011127571 A * 6/2011
(Continued)

OTHER PUBLICATIONS

International Search Report (PCT/ISA/210) issued in PCT Application No. PCT/JP2022/000711 dated Mar. 15, 2022 with English translation (6 pages).
(Continued)

*Primary Examiner* — Syed O Hasan
(74) *Attorney, Agent, or Firm* — Crowell & Moring LLP

(57) ABSTRACT

An internal combustion engine control device includes a correlation index estimation unit configured to estimate a piston temperature correlation index correlated with a temperature of a piston based on an internal combustion engine operating condition parameter and an oil jet parameter for injecting oil to a back surface of the piston; and a hydraulic pressure setting unit configured to set a hydraulic pressure of an oil jet based on the piston temperature correlation index and an evaporation parameter of fuel attached to the piston, wherein when the piston temperature correlation index is less than a first predetermined value determined based on a temperature corresponding to a fuel evaporable condition as the evaporation parameter, the hydraulic pressure setting unit sets the hydraulic pressure of the oil jet to a hydraulic pressure at which oil jet injection can be stopped.

4 Claims, 9 Drawing Sheets

(56) References Cited

FOREIGN PATENT DOCUMENTS

| | | | | |
|---|---|---|---|---|
| JP | 2013-64374 | A | | 4/2013 |
| JP | 2013064374 | A | * | 4/2013 |
| JP | 2014-159760 | A | | 9/2014 |
| JP | 2019-157835 | A | | 9/2019 |
| JP | 2021-55562 | A | | 4/2021 |
| JP | 2021055562 | A | * | 4/2021 |

OTHER PUBLICATIONS

Japanese-language Written Opinion (PCT/ISA/237) issued in PCT Application No. PCT/JP2022/000711 dated Mar. 15, 2022 with English translation (11 pages).

* cited by examiner

INTERNAL COMBUSTION ENGINE CONTROL DEVICE AND INTERNAL COMBUSTION ENGINE CONTROL METHOD

TECHNICAL FIELD

The present invention relates to an internal combustion engine control device and an internal combustion engine control method for operating various actuators of an internal combustion engine.

BACKGROUND ART

Normally, an internal combustion engine mounted on a vehicle operates according to operation amounts of various actuators adapted under specific environmental conditions such as temperature, humidity, and atmospheric pressure. For example, at the time of traveling on an actual road, there is a case where the vehicle travels under a condition deviated from an environmental condition assumed at the time of adaptation or a state (operating condition) of the internal combustion engine. This environmental condition is detected using various sensors, and the operation amount is corrected according to the detected condition.

In addition, at the time of traveling on the actual road, not only the environmental condition is different from the adaptation condition, and the state of the internal combustion engine itself (e.g., a wall surface temperature of the combustion chamber, a cooling water temperature, and a component) may also change and deviate from the state assumed at the time of adaptation. For this reason, in order to improve various performances (fuel consumption performance and exhaust performance) of the automobile at the time of traveling on the actual road, it is important to grasp the state of the internal combustion engine in operation by estimating and detecting the state of the internal combustion engine and to operate the actuator according to the grasped state of the internal combustion engine.

As a state related to the performance of the internal combustion engine, there is a temperature (wall surface temperature) of a wall of a combustion chamber of the internal combustion engine. Here, the wall surface temperature is a temperature of a wall constituting the combustion chamber, and examples of the wall include, for example, a head part of the combustion chamber, a liner portion of the combustion chamber, and a piston.

The wall surface temperature is a physical quantity related to the operation amount of the actuator that affects the fuel consumption performance and the exhaust performance. For example, under a condition where the wall surface temperature is high, the heating of the gas near the wall surface proceeds, so that abnormal combustion (knocking) is likely to occur. Therefore, it is required to devise an operation of the actuator to suppress deterioration of combustion efficiency. On the other hand, under a condition where the wall surface temperature is low, the fuel attached to the wall surface tends to remain as liquid, which may lead to generation of unburned hydrocarbon and soot, leading to the possibility of the exhaust performance deteriorating.

For example, PTL 1 discloses a technique of estimating a piston surface temperature and controlling an actuator provided in an internal combustion engine. PTL 1 proposes a method of controlling a piston temperature by actuating an oil jet that blows oil to a back surface of a piston when a piston surface temperature is greater than or equal to a predetermined threshold temperature based on a 90% distillation temperature of the fuel.

CITATION LIST

Patent Literature

PTL 1: JP 2013-64374 A

SUMMARY OF INVENTION

Technical Problem

In the technique described in PTL 1, when the piston surface temperature is less than a predetermined threshold temperature based on the 90% distillation temperature of the fuel, the oil jet is stopped to promote an increase in the piston temperature, suppress the fuel attached to the piston surface from remaining, and suppress the discharge amount of particulate matter. On the other hand, since the 90% distillation temperature of the fuel is defined as 180° C. or lower in the JIS standard, it is considered that the piston surface temperature is usually in a state of at least 100° C. or higher during the operation. From this, by defining a predetermined temperature threshold based on the 90% distillation temperature and defining the actuation and stop of the oil jet, it is assumed that the oil jet continues to be stopped for a long period of time from the start.

Stopping the oil jet will reduces the amount of energy flowing from the piston to the oil. As a result, the temperature rise of the engine oil becomes slow, and there is a possibility that the improvement margin of the fuel consumption is not taken. In other words, since the viscosity of the engine oil increases as the temperature of the engine oil decreases, there is a possibility that the fuel consumption is impaired by the friction between the liner portion of the combustion chamber and the piston.

In view of the above circumstances, there has been a demand for a method of controlling energy transmitted to a piston or engine oil to improve exhaust performance and fuel consumption performance of an internal combustion engine.

Solution to Problem

In order to solve the above problem, an internal combustion engine control device according to one aspect of the present invention includes a correlation index estimation unit configured to estimate a piston temperature correlation index correlated with a temperature of a piston based on an operating condition parameter and an oil jet parameter for injecting oil to a back surface of the piston; and a hydraulic pressure setting unit configured to set a hydraulic pressure of an oil jet based on the piston temperature correlation index and an evaporation parameter of fuel attached to the piston, wherein when the piston temperature correlation index is less than a first predetermined value determined based on a temperature corresponding to a fuel evaporable condition as the evaporation parameter, the hydraulic pressure setting unit sets the hydraulic pressure of the oil jet to a hydraulic pressure at which oil jet injection can be stopped.

Advantageous Effects of Invention

According to at least one aspect of the present invention, the oil jet injection amount is appropriately operated by operating the hydraulic pressure of the oil jet in view of the operating condition affecting the wall surface temperature of the piston and the piston temperature. As a result, since the amount of energy flowing to the piston and the engine oil can be operated, improvement in exhaust performance and fuel consumption performance of the internal combustion engine can be realized. Problems, configurations, and effects other than those described above will be clarified by the following description of embodiment.

DESCRIPTION OF EMBODIMENT

Figure 1:
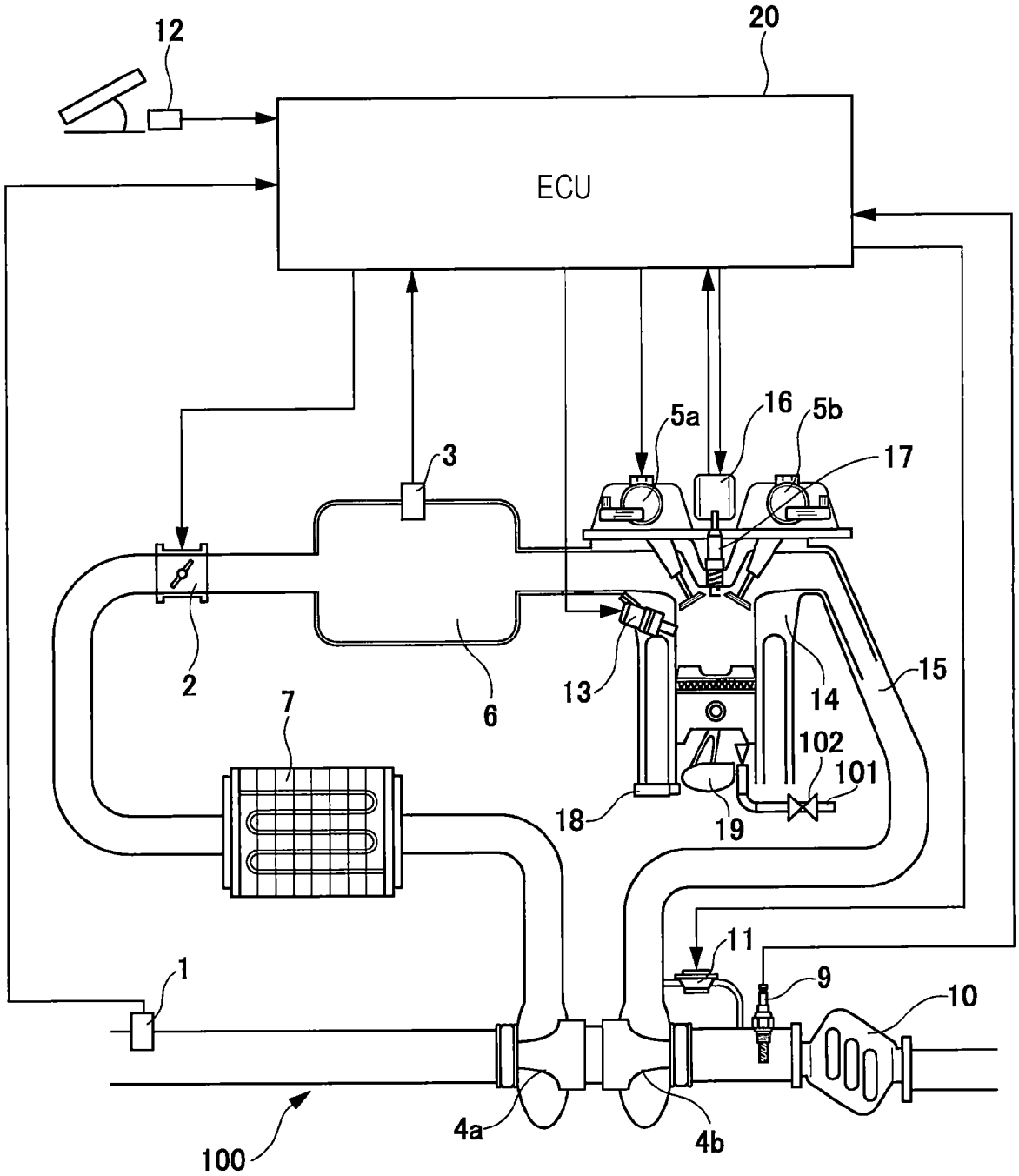
FIG. 1 is a schematic configuration diagram illustrating an example of a system configuration of an internal combustion engine on which an internal combustion engine control device according to an embodiment of the present invention is mounted.

Hereinafter, examples of modes for carrying out the present invention will be described with reference to the accompanying drawings. In the present specification and the accompanying drawings, components having substantially the same function or configuration are denoted by the same reference numerals, and redundant description will be omitted.

<Configuration of Internal Combustion Engine>

First, a configuration example of an internal combustion engine will be described.

FIG. 1 is a schematic configuration diagram illustrating a system configuration of an internal combustion engine. An internal combustion engine 100 illustrated in FIG. 1 illustrates a system configuration of a spark ignition type internal combustion engine used in an automobile, and includes an in-cylinder fuel injection valve that directly injects fuel made of gasoline into a cylinder. Note that the internal combustion engine 100 is not limited to an in-cylinder injection type internal combustion engine (direct injection engine), and a port injection type internal combustion engine that injects fuel to a suction port may be applied.

The internal combustion engine 100 is a four-cycle engine that repeats four strokes of a suction stroke, a compression stroke, combustion (expansion) a stroke, and an exhaust stroke. Furthermore, the internal combustion engine 100 is, for example, a multi-cylinder engine including four cylinders (cylinders). Note that the number of cylinders included in the internal combustion engine 100 is not limited to four, and may include six or eight or more cylinders. The number of cycles of the internal combustion engine 100 is not limited to 4 cycles.

As illustrated in FIG. 1, the internal combustion engine 100 includes an air flow sensor 1, an electronically controlled throttle valve 2, an intake pressure sensor 3, a compressor 4*a*, an intercooler 7, and a cylinder 14. The air flow sensor 1, the electronically controlled throttle valve 2, the intake pressure sensor 3, the compressor 4*a*, and the intercooler 7 are disposed at positions up to the cylinder 14 in an intake pipe 6.

The air flow sensor 1 measures an intake air amount and an intake air temperature. The electronically controlled throttle valve 2 is driven so as to be openable and closable by a drive motor (not illustrated). Then, the opening degree of the electronically controlled throttle valve 2 is adjusted based on the driver's accelerator operation. Thus, the amount of air taken in is adjusted, and the pressure of the intake pipe 6 is adjusted. The intake pressure sensor 3 measures the pressure of the intake pipe 6.

The compressor 4*a* compresses intake air to be supercharged in the supercharger. The rotating force is transmitted to the compressor 4*a* by a turbine 4*b* to be described later. The intercooler 7 is disposed on the upstream side of the cylinder 14 and cools intake air.

In the internal combustion engine 100, a fuel injection device 13 that injects fuel into the cylinder of the cylinder 14, and an ignition device including an ignition coil 16 and an ignition plug 17 that supply ignition energy are provided for each cylinder 14. The ignition coil 16 generates a high voltage under the control of an internal combustion engine control device 20 and applies the high voltage to the ignition plug 17. As a result, sparks are generated in the ignition plug 17. Then, an air-fuel mixture in the cylinder burns and explodes by the spark generated in the ignition plug 17. For example, an engine control unit (ECU) can be used as the internal combustion engine control device 20.

A voltage sensor (not illustrated) is attached to the ignition coil 16. The voltage sensor measures a primary-side voltage or a secondary-side voltage of the ignition coil 16. Then, the voltage information measured by the voltage sensor is sent to the internal combustion engine control device 20.

The cylinder head of the cylinder 14 is provided with a variable valve 5*a* and a variable valve 5*b*. The variable valve 5*a* adjusts the air-fuel mixture flowing into the cylinder of the cylinder 14, and the variable valve 5*b* adjusts the exhaust gas discharged from the cylinder. The intake air amount and the internal EGR (Exhaust Gas Recirculation) amount of all the cylinders 14 are adjusted by adjusting the variable valves 5*a* and 5*b*.

Furthermore, a piston is slidably disposed in the cylinder of the cylinder 14. The piston compresses an air-fuel mixture of fuel and gas flowing into the cylinder of the cylinder 14. Then, the piston reciprocates in the cylinder of the cylinder 14 by the combustion pressure generated in the cylinder. In addition, a crank angle sensor 19 for detecting the position of the piston is attached to the internal combustion engine 100. The crank angle information (rotation information) measured by the crank angle sensor 19 is sent to the internal combustion engine control device 20.

The fuel injection device 13 is controlled by an internal combustion engine control device 20 (ECU) to inject fuel into the cylinder of the cylinder 14. As a result, an air-fuel mixture mixed with fuel of air is generated in the cylinder of the cylinder 14. A high-pressure fuel pump (not illustrated) is connected to the fuel injection device 13. Fuel whose pressure is increased by the high-pressure fuel pump is supplied to the fuel injection device 13. Furthermore, a fuel pressure sensor for measuring the fuel injection pressure is provided in the fuel pipe connecting the fuel injection device 13 and the high-pressure fuel pump.

The cylinder 14 is provided with a temperature sensor 18. The temperature sensor 18 measures the temperature of the cooling water around the cylinder 14. As a cooling water device, there is a water pump (not illustrated), and the flow rate of the cooling water around the cylinder 14 is adjusted by the water pump. As the water pump, a water pump that is driven using the output of the internal combustion engine, a motorized water pump (electric water pump), or the like is applied. Although not illustrated, as a device for adjusting the cooling water, in addition to the water pump, a thermostat for controlling the cooling water flowing into the cylinder, and a valve for switching a flowing direction of the cooling water to each component such as a heat exchanger and a cylinder provided in the internal combustion engine may be provided.

Furthermore, each cylinder 14 of the internal combustion engine 100 is provided with an oil jet system 101 (piston cooling device). The oil jet system 101 is connected to a variable displacement type oil pump 54 (see FIG. 2), and cooling oil (e.g., engine oil) is supplied from the oil pump 54. The oil jet system 101 injects cooling oil to the back surface of the piston to lower the temperature of the piston. As the cooling oil, engine oil is generally used. When the internal combustion engine control device 20 adjusts the output (flow rate, hydraulic pressure) of the oil pump 54, the amount of oil injected from the oil jet system 101 toward the piston changes.

A valve 102 is provided in an oil flow path of the oil jet system 101. The valve 102 is provided between an oil main gallery 110 and an oil jet nozzle outlet. In this example, the valve 102 is disposed between the oil pump 54 and the oil jet nozzle outlet.

Furthermore, an exhaust pipe 15 is connected to an exhaust port of the cylinder 14. The exhaust pipe 15 is provided with a turbine 4*b*, an electronically controlled wastegate valve 11, a three-way catalyst 10, and an air-fuel ratio sensor 9. The turbine 4*b* is rotated by the exhaust gas passing through the exhaust pipe 15, and transmits the rotating force to the compressor 4*a*. In addition, the electronically controlled wastegate valve 11 connected to connect the upstream side and the downstream side of the turbine 4*b* adjusts the exhaust flow rate flowing to the turbine 4*b*.

The three-way catalyst 10 is disposed on the downstream side of the turbine 4*b*. The three-way catalyst 10 purifies harmful substances contained in the exhaust gas by an oxidation/reduction reaction. The air-fuel ratio sensor 9 is disposed on the upstream side of the three-way catalyst 10. Then, the air-fuel ratio sensor 9 detects the air-fuel ratio of the exhaust gas passing through the exhaust pipe 15.

Furthermore, signals detected by the respective sensors such as the air flow sensor 1, the intake pressure sensor 3, and the voltage sensor are sent to the internal combustion engine control device 20. In addition, a signal detected by an accelerator opening degree sensor 12 that detects the depression amount of the accelerator pedal, that is, the accelerator opening degree is also sent to the internal combustion engine control device 20.

The internal combustion engine control device 20 calculates the required torque based on the output signal of the accelerator opening degree sensor 12. That is, the accelerator opening degree sensor 12 is used as a required torque detection sensor that detects a required torque to the internal combustion engine 100. In addition, the internal combustion engine control device 20 calculates the rotational speed of the internal combustion engine 100 based on the output signal of the crank angle sensor 19. Then, the internal combustion engine control device 20 optimally calculates main operation amounts of the internal combustion engine 100 such as an air flow rate (intake flow rate), a fuel injection amount, an ignition timing, a throttle opening degree, and a fuel pressure based on an operation state of the internal combustion engine 100 obtained from output signals of various sensors.

The fuel injection amount calculated by the internal combustion engine control device 20 is converted into a valve opening pulse signal and output to the fuel injection device 13. In addition, the ignition timing calculated by the internal combustion engine control device 20 is output to the ignition plug 17 as an ignition signal. Furthermore, the throttle opening degree calculated by the internal combustion engine control device 20 is output to the electronically controlled throttle valve 2 as a throttle drive signal.

In the internal combustion engine 100 configured as described above, fuel is injected from the fuel injection device 13 to the air flowing into the cylinder 14 from the intake pipe 6 through the intake valve (variable valve 5*a*), and an air-fuel mixture is formed in the cylinder. The air-fuel mixture explodes by a spark generated from the ignition plug 17 at a predetermined ignition timing, whereby the piston is pushed down by the combustion pressure thereof to become a driving force of the internal combustion engine 100. Furthermore, the exhaust gas after the explosion is sent to the three-way catalyst 10 via the exhaust pipe 15, and the exhaust components are purified in the three-way catalyst 10 and discharged to the outside.

Note that the internal combustion engine 100 may be provided with an EGR pipe (not illustrated) that connects the intake pipe 6 and the exhaust pipe 15. A part of the exhaust gas passing through the exhaust pipe 15 may be returned to the intake pipe 6 by the EGR pipe.

[Configuration of Oil Pump]

Next, an outline of a configuration of the variable displacement type oil pump 54 used for the internal combustion engine 100 will be described with reference to FIG. 2.

Figure 2:
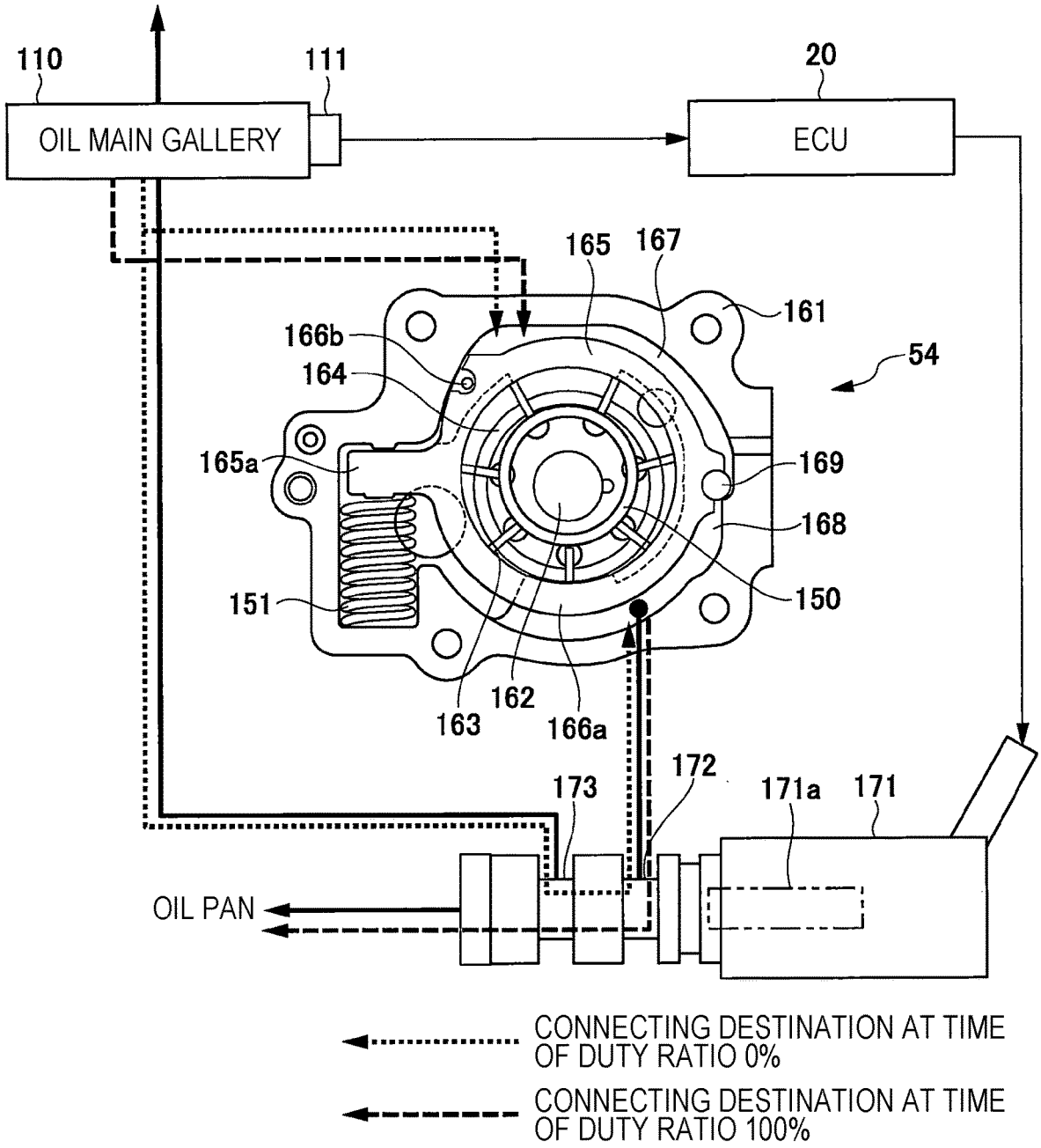
FIG. 2 is a schematic cross-sectional view illustrating a configuration example of a variable displacement type oil pump used in an internal combustion engine.

FIG. 2 is a schematic cross-sectional view illustrating a configuration example of a variable displacement type oil pump 54. As described above, the variable displacement type oil pump 54 can variably control the pressure (hydraulic pressure) of the discharged oil. In the oil pump 54, suction ports and discharge ports are provided on both side portions of the pump housing 161. Furthermore, a drive shaft 162 through which a rotating force is transmitted from a crank shaft of the internal combustion engine 100 is passed through and disposed substantially at the center of the oil pump 54.

A rotor 164 and a cam ring 165 are accommodated and disposed inside the pump housing 161.

The rotor 164 is coupled to the drive shaft 162. The rotor 164 holds a plurality of vanes 163 on the outer peripheral side so as to be freely movable forward and backward in substantially the radial direction.

The cam ring 165 is provided on the outer peripheral side of the rotor 164 so as to be freely eccentrically swingable. The tip of each vane 163 is in sliding contact with the inner peripheral surface of the cam ring 165. A pair of vane rings 150 is slidably disposed on both side surfaces on the inner peripheral portion side of the rotor 164.

On the outer peripheral portion side of the cam ring 165, an operation chamber 167 and an operation chamber 168 are formed so as to be partitioned by seal members 166*a* and 166*b*. The cam ring 165 swings about the pivot pin 169 in a direction in which an eccentric amount decreases according to a discharge pressure of oil introduced into the operation chamber 167 and the operation chamber 168. Furthermore, the cam ring 165 has a lever portion 165*a* integrally formed on the outer periphery thereof. The lever portion 165*a* is formed so as to protrude in the outer peripheral direction of the cam ring 165. The cam ring 165 swings in a direction in which the eccentric amount increases by the spring force of the coil spring 151 that presses the lever portion 165*a* in a direction substantially perpendicular to the rotating direction of the crankshaft.

In the initial state, the internal combustion engine control device 20 biases the cam ring 165 in the direction in which the eccentric amount is maximized by the spring force of the coil spring 151 to increase the discharge pressure of the oil pump 54. On the other hand, when the hydraulic pressure in the operation chamber 167 becomes greater than or equal to a predetermined value, the internal combustion engine control device 20 swings the cam ring 165 in a direction in which the eccentric amount decreases against the spring force of the coil spring 170 to reduce the discharge pressure.

Oil (lubricating oil) is supplied from the oil main gallery 110 to the operation chamber 167 of the oil pump 54, and oil is supplied to the operation chamber 168 via an oil control valve 171 including a proportional solenoid valve. Then, the oil discharged from the oil pump 54 is supplied to a hydraulic pressure valve timing control (VTC) mechanism that controls the above-described variable valves 5*a* and 5*b* (see FIG. 1) of the internal combustion engine 100, an oil jet mechanism that cools a piston, and the like.

In the oil control valve 171, a first opening 172 and a second opening 173 are formed in a main body. Furthermore, the oil control valve 171 interiorly includes a proportional solenoid 171*a* and a substantially cylindrical valve body (not illustrated) that moves by receiving thrust generated in the proportional solenoid 171*a* by excitation. A groove designed in consideration of the positions of the first opening 172 and the second opening 173 is formed on the inner peripheral surface of the substantially cylindrical valve body. The valve body moves in the axial direction (left-right direction in FIG. 2) of the oil control valve 171 according to the thrust generated by the proportional solenoid 171*a*. Depending on the position of the valve body, the relative positional relationship between the groove of the valve body and the first opening 172 and the second opening 173 changes, and the flow path changes. When the valve body is in the first position, the operation chamber 168 of the oil pump communicates with the oil pan through the first opening 172. When the valve body is in the second position, the operation chamber 168 of the oil pump communicates with the oil main gallery 110 through the first opening 172 and the second opening 173.

The oil control valve 171 is duty controlled by a drive signal (pulse width modulation (PWM) signal) from the internal combustion engine control device 20. The proportional solenoid 171*a* in the oil control valve 171 is excited according to the duty ratio of the drive signal, and the valve body is driven to a target control position.

The oil pump 54 is configured to control the eccentric amount of the vanes 163 in accordance with the hydraulic pressure difference between the operation chamber 167 and the operation chamber 168, thereby operating the hydraulic pressure (hereinafter, also referred to as "discharge hydraulic pressure") of the discharge oil. The oil pump 54 performs the following control.

- When the hydraulic pressure difference between the operation chamber 167 and the operation chamber 168 is large, the discharge hydraulic pressure is reduced by reducing the eccentric amount of the vane 163 (cam ring 165).
- When the hydraulic pressure difference between the operation chamber 167 and the operation chamber 168 is small, the discharge hydraulic pressure is increased by increasing the eccentric amount of the vane 163 (cam ring 165).

The operation of the hydraulic pressure in the operation chamber 168 can be realized by controlling the introduction and discharge of oil into and from the operation chamber 168. That is, the hydraulic pressure in the operation chamber 168 is operated by the duty ratio of the drive signal supplied to the oil control valve 171. The relationship between the duty ratio of the drive signal and the discharge hydraulic pressure is as follows.

- When the duty ratio is 100%, the valve body in the oil control valve 171 moves to a position where the operation chamber 168 communicates with the oil pan, and the hydraulic pressure in the operation chamber 168 decreases (=the hydraulic pressure in the operation chamber 168 is equivalent to the oil pan (1 atmospheric pressure)). As a result, the eccentric amount of the vane 163 (cam ring 165) of the oil pump 54 is minimized, and the discharge hydraulic pressure is minimized.
- When the duty ratio is 0%, the valve body in the oil control valve 171 moves to a position where the operation chamber 168 communicates with the oil main gallery 110, and the hydraulic pressure in the operation chamber 167 increases (=the hydraulic pressure in the operation chamber 168 is equivalent to the hydraulic pressure in the oil main gallery 110). As a result, the eccentric amount of the vane 163 (cam ring 165) of the oil pump 54 is maximized, and the discharge hydraulic pressure is maximized.

As described above, when the duty ratio of the drive signal is large, the operation chamber 168 communicates with the drain (oil pan) via the oil control valve 171. As a result, the discharge oil of the oil pump 54 is in a low-pressure state. On the other hand, when the duty ratio of the drive signal is small, the oil main gallery 110 and the operation chamber 168 communicate with each other via the oil control valve 171 to act hydraulic pressure on the operation chamber 167. As a result, the discharge oil of the oil pump 54 is in a high-pressure state. The pressure of the discharge oil of the oil pump 54 can be adjusted within a range from the maximum to the minimum by operating the duty ratio of the drive signal between 100% and 0%.

Also. A hydraulic sensor 111 is disposed on the oil main gallery 110. The hydraulic sensor 111 measures the pressure of the oil in the oil main gallery 110 and outputs a signal corresponding to the hydraulic pressure. The hydraulic pressure in the oil main gallery 110 is correlated with the pressure (discharge hydraulic pressure) of the oil discharged from the oil pump 54. In the present embodiment, the discharge hydraulic pressure of the oil pump 54 is detected by acquiring the output signal of the hydraulic sensor 111. The output signal of the hydraulic sensor 111 is input to the internal combustion engine control device 20, and is used to feedback control the discharge hydraulic pressure of the oil pump 54 to the target discharge hydraulic pressure. Of course, it goes without saying that the hydraulic pressure obtained from the output signal of the hydraulic sensor 111 can be used for other control. Hereinafter, when simply described as "hydraulic pressure", it means the discharge hydraulic pressure of the oil pump 54.

The oil supplied and injected to each mechanism and the oil discharged from the oil control valve 171 are recovered in the oil pan, then supplied again to the oil main gallery 110, and supplied and injected to each mechanism described above.

In place of the variable displacement type oil pump 54 described above, an oil pump whose hydraulic pressure increases in proportion to the rotation number may be used. In general, such an oil pump cannot lower the hydraulic pressure under a low temperature condition, and the oil jet stop state cannot be made by the pump alone. Therefore, in order to make the oil jet stop state, it is necessary to provide a solenoid valve for stopping the oil jet. Since the variable displacement type oil pump 54 can perform hydraulic pressure control in the entire temperature range including low temperature, a solenoid valve for switching execution/non-execution of oil jet injection becomes unnecessary.

<Configuration of Internal Combustion Engine Control Device>

Next, a configuration example of the internal combustion engine control device 20 to which the present invention is applied will be described with reference to FIG. 3.

Figure 3:
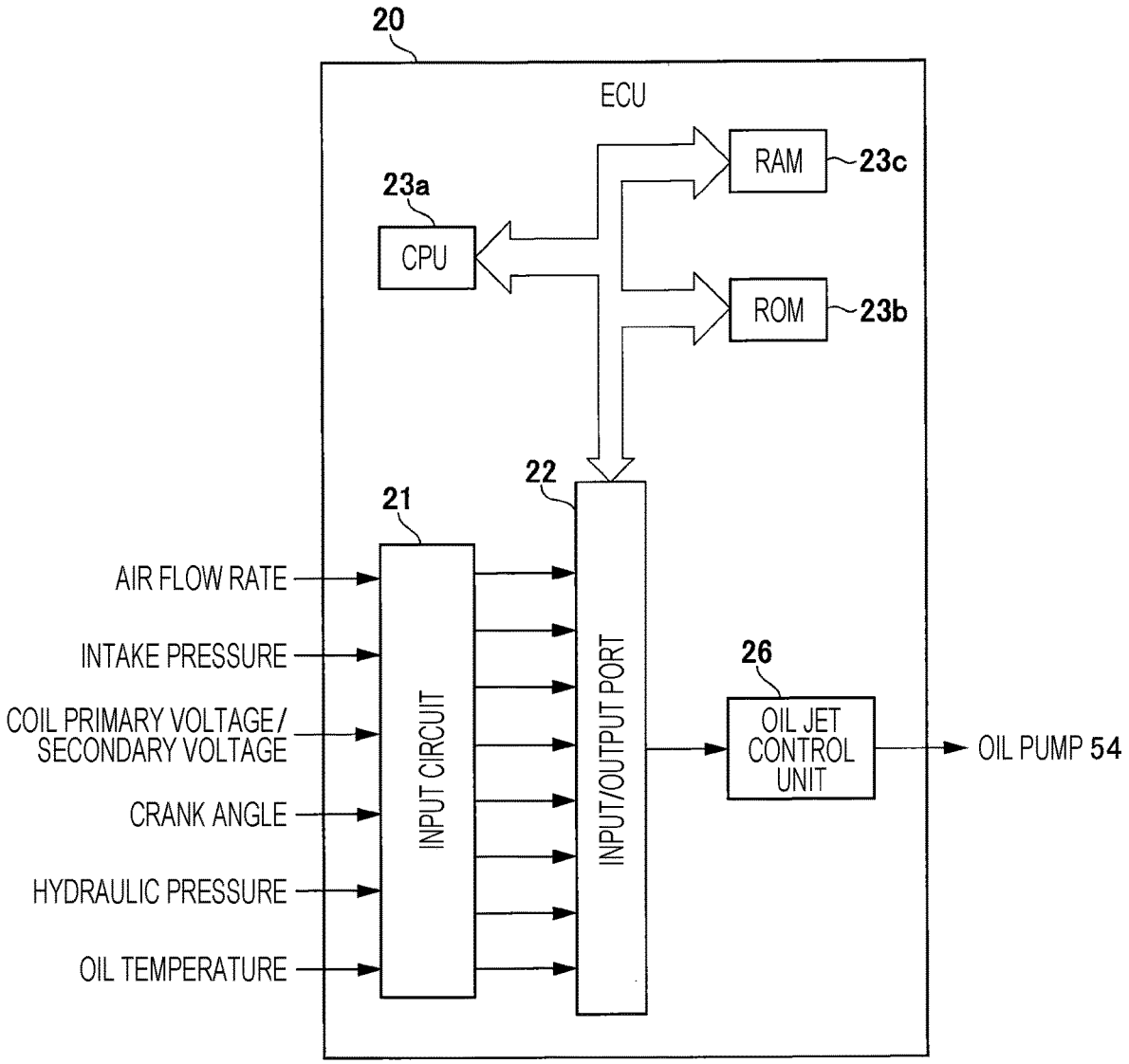
FIG. 3 is a block diagram illustrating a configuration example of an internal combustion engine control device to which the present invention is applied.

FIG. 3 is a block diagram illustrating a configuration example of the internal combustion engine control device 20. As illustrated in FIG. 3, the internal combustion engine control device 20 which is an ECU includes an input circuit 21, an input/output port 22, a random access memory (RAM) 23*c*, a read only memory (ROM) 23*b*, and a central processing unit (CPU) 23*a*. The internal combustion engine control device 20 includes an oil jet control unit 26.

For example, a signal of the air flow rate from the air flow sensor 1 (see FIG. 1), a signal of the intake pressure from the intake pressure sensor 3, and a signal of the coil primary voltage or the secondary voltage from the voltage sensor are input to the input circuit 21. Signals of a crank angle (rotation number) from the crank angle sensor 19, an oil pressure (hydraulic pressure) and an oil temperature (oil temperature) from each sensor included in the oil jet system 101 are input to the input circuit 21. Not only these pieces of information but also information measured by various sensors such as a throttle opening degree and an exhaust air-fuel ratio are input to the input circuit 21.

The input circuit 21 performs signal processing such as noise removal on the input signal and sends the signal to the input/output port 22. The value of the signal input to the input port of the input/output port 22 is temporarily stored in the RAM 23*c*.

The ROM 23*b* stores a control program describing contents of various arithmetic process executed by the CPU 23*a*, a map, a data table, and the like used for each process. The control program, the map, the data table, and the like used for each process may be stored in a non-volatile storage (not illustrated). The RAM 23*c* is provided with a storage area for storing a value input to the input port of the input/output port 22 and a value representing the operation amount of each actuator calculated according to the control program. In addition, the value representing the operation amount of each actuator stored in the RAM 23*c* is sent to the output port of the input/output port 22.

The operation amount of the oil pump 54 set in the output port of the input/output port 22 is sent to the oil jet control unit 26. The oil jet control unit 26 generates a control signal based on the operation amount of the oil pump 54, and a drive circuit (not illustrated) supplies a drive signal based on the control signal to the oil pump 54. In this manner, the oil jet control unit 26 controls the pressure (hydraulic pressure) of the oil output from the oil pump 54 that supplies oil to the oil jet system 101 (see FIG. 1). The oil jet control unit 26 adjusts the amount of oil injected from the oil jet system 101 by controlling the hydraulic pressure of the oil pump 54, thereby controlling the temperature change of the piston.

Note that actuators other than these are also used in the internal combustion engine 100, and the internal combustion engine control device 20 includes an ignition control unit, a fuel injection control unit, and the like (not illustrated) that control these actuators, but the description thereof will be omitted here. In the present embodiment, an example in which the internal combustion engine control device 20 includes the oil jet control unit 26 has been described, but the present invention is not limited thereto. For example, the oil jet control unit 26 may be mounted on a control device different from the internal combustion engine control device 20.

<Outline of Control of Internal Combustion Engine Control Device>

Next, an outline of control executed by the internal combustion engine control device 20 will be described with reference to FIG. 4.

Figure 4:
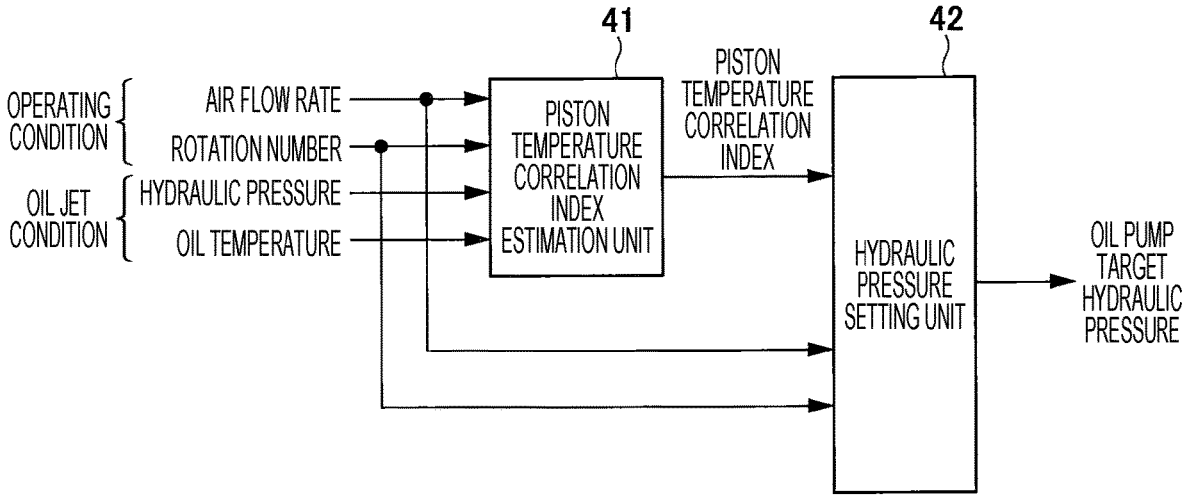
FIG. 4 is a control block diagram illustrating an outline of control executed by the internal combustion engine control device according to one embodiment of the present invention.

FIG. 4 is a control block diagram illustrating an outline of control executed by the internal combustion engine control device 20 according to one embodiment of the present invention. The internal combustion engine control device 20 includes a piston temperature correlation index estimation unit 41 and a hydraulic pressure setting unit 42. The CPU 23*a* (see FIG. 3) executes a control program recorded in the ROM 23*b* or the like, thereby realizing the function of each processing block.

[Piston Temperature Correlation Index Estimation Unit]

The piston temperature correlation index estimation unit 41 (an example of a correlation index estimation unit) is a processing block that estimates a piston temperature correlation index correlated with the temperature of the piston based on the operating condition parameters and the oil jet parameters of the internal combustion engine 100. In the example of FIG. 4, the air flow rate of the intake pipe 6 and the engine speed (crank angle) are input as the operating condition parameters, and the discharge hydraulic pressure of the oil pump 54 and the oil temperature of the oil jet are input as the oil jet parameters. For example, an oil temperature sensor is provided in an oil pan (not illustrated), and the oil temperature sensor measures the temperature of the oil flowing in the oil pan. Note that the place where the oil temperature is measured is not limited to the oil pan, and may be a place closer to the oil pump 54.

For example, the piston temperature correlation index estimation unit 41 may estimate the piston temperature itself as the piston temperature correlation index. For example, the piston temperature change can be sequentially estimated from the balance between the energy input to the piston and the energy released. For example, the following Mathematical Formula 1 may be calculated. The energy assumes thermal energy.

$$Tpis = (Tpis, 0) + (Qinp - (Qout, 1) - (Qout, oj) - (Qout, res)) \div (Mpis \times Cpis) \quad \text{[Mathematical Formula 1]}$$

Here, Tpis is an updated value (estimated value) of the piston temperature, and (Tpis, 0) is a current value of the piston temperature. Qinp is the energy (J) transferred from the combustion gas to the piston to the piston, and (Oout, l) is the energy (J) transferred from the piston to the cylinder liner through the piston ring and piston skirt (part in contact with the cylinder inner wall). (Qout, oj) is the energy (J) transferred from the piston to the oil jet, and (Qout, res) is the energy (J) flowing from the piston to the outside through a crankshaft or the like. Furthermore, Mpis is the mass of the piston (kg) and Cpis is the specific heat of the piston (J/kg/K). For example, Qinp, (Qout, l), and (Qout, oj) can be calculated using the following Mathematical Formulas 2, 3, and 5.

$$Qinp = (Mdot, f) \times Qf \times \eta pis \times \Delta\tau \quad \text{[Mathematical Formula 2]}$$

$$(Qout, 1) = Spl \times \lambda pl \times ((Tpis, 0) - Tc) \times \Delta\tau \quad \text{[Mathematical Formula 3]}$$

$$(Qout, oj) = Spo \times hpis \times ((Tpis, 0) - Toil) \times \Delta\tau \quad \text{[Mathematical Formula 4]}$$

Here, (Mdot, f) is a fuel flow rate (kg/s), Qf is a low calorific value (J) of the fuel, ηpis is a proportion (–) of energy transferred to the piston, and Δτ is a calculation period(s). Spl is the contact area (m2) between the piston and the liner portion, λpl is the thermal conductivity (W/(m·K)) between the piston and the liner portion, and Tc is the cooling water temperature (° C.). Spo is the contact area (m2) between the oil jet and the piston, hpis is the heat transfer coefficient of the oil jet, and Toil is the oil temperature of the oil jet (° C.).

A value of Qfl may be set in advance on the assumption of, for example, gasoline. The Spl may be given by the contact area between the piston ring and the liner portion, and can be easily set based on geometric information such as the thickness of the piston ring and the bore diameter (e.g., thickness of piston ring×bore diameter×circular constant). Spo can be set based on the geometric information of the piston (e.g., bore diameter×bore diameter×circular constant÷4). In addition, ηpis can be given with a map based on the operating condition, the piston temperature, the cooling temperature, and the oil temperature, and this map needs to be determined in advance by experiments or simulations. In addition, hpis is a parameter that depends on the oil jet shape and the oil jet flow rate. From this, hpis can be identified in advance by measurement such as experiment or simulation, and a map can be created. For example, the relationship between the hydraulic pressure and the oil jet flow rate illustrated in FIG. 5 and the relationship between the oil jet flow rate and the heat transfer coefficient hpis illustrated in FIG. 6 are used.

Figure 5:
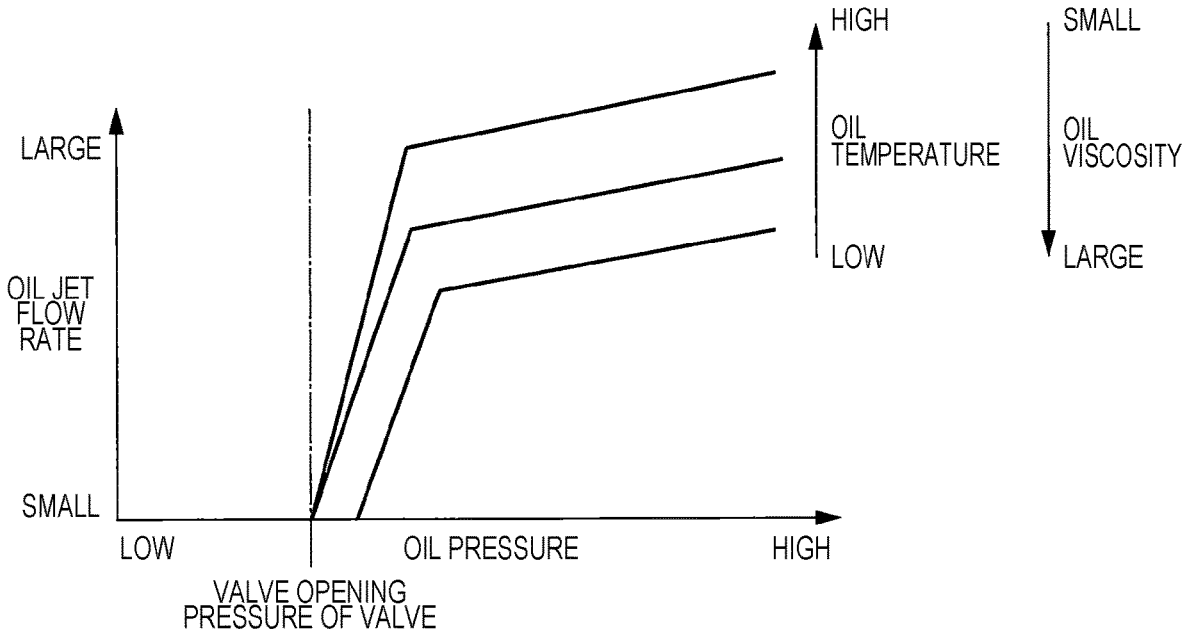
FIG. 5 is a map (graph) illustrating an example of a relationship between the oil pressure and the oil jet flow rate.

FIG. 5 is a map (graph) illustrating an example of a relationship between the oil pressure and the oil jet flow rate. In FIG. 5, the vertical axis represents the oil jet flow rate, and the horizontal axis represents the oil pressure.

Figure 6:
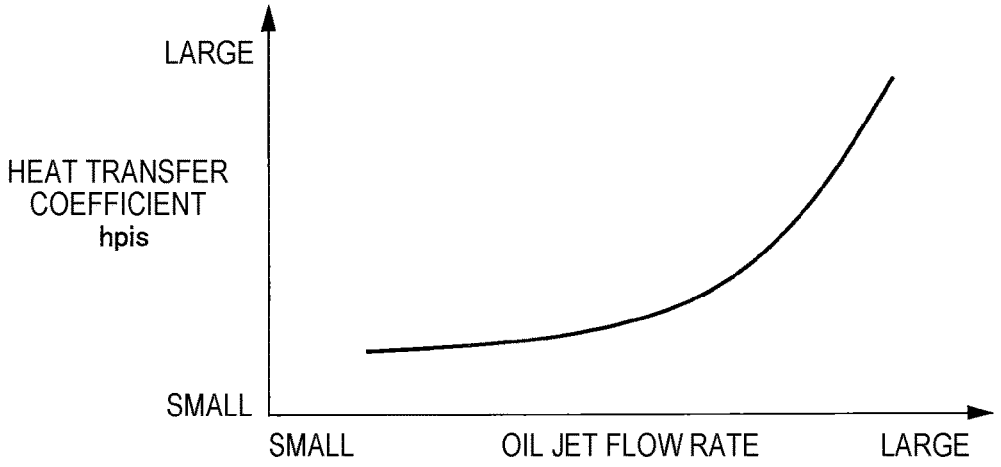
FIG. 6 is a map showing an example of a relationship between an oil jet flow rate and a heat transfer coefficient between a piston and an oil jet.

FIG. 6 is a map illustrating an example of a relationship between the oil jet flow rate and the heat transfer coefficient hpis between the piston and the oil jet. In FIG. 6, the vertical axis represents the heat transfer coefficient (hpis), and the horizontal axis represents the oil jet flow rate.

As illustrated in FIG. 5, the oil jet flow rate becomes a value of greater than or equal to 0 at a hydraulic pressure of greater than or equal to the valve opening pressure of the valve 102, and the flow rate increases as the hydraulic pressure increases. In addition, in the case where comparison is performed at the same hydraulic pressure, there is a relationship in which the oil viscosity decreases and the oil jet flow rate increases as the oil temperature increases. As illustrated in FIG. 6, the heat transfer coefficient hpis has a positive correlation with respect to the oil jet flow rate. Therefore, as the oil jet flow rate increases, the heat transfer coefficient hpis increases. The current oil jet flow rate can be calculated from the hydraulic pressure, the oil temperature, and the relationship illustrated in FIG. 5, and furthermore, the heat transfer coefficient hpis can be calculated from the calculated oil jet flow rate and the relationship illustrated in FIG. 6. The fuel flow rate (Mdot, f) can be calculated from the air flow rate (Mdot, a) measured by the air flow sensor 1 and the exhaust air-fuel ratio AbF (–) detected by the air-fuel ratio sensor 9, for example, as illustrated in Mathematical Formula 5.

$$(Mdot, f) = (Mdot, a) \div AbF \quad \text{[Mathematical Formula 5]}$$

As described above, the piston temperature correlation index can be calculated.

(Another Calculation Method of Piston Temperature Correlation Index)

In addition, it is clear that there is a qualitative tendency that the piston temperature rises as the combustion operation in the internal combustion engine continues and lowers when the combustion operation of the internal combustion engine stops. For this reason, the time during which the combustion operation of the internal combustion engine is continued (combustion operation duration) may be used for the calculation of the piston temperature correlation index. For example, it can be given by the following formula.

$$tcomb = (tcomb, 0) + \Delta\tau \text{ (At time of combustion operation)} \quad \text{[Mathematical Formula 6]}$$

$$tcomb = (tcomb, 0) - \Delta\tau stop \text{ (At time of fuel cut, at time of engine stop)} \quad \text{[Mathematical Formula 7]}$$

Here, tcomb is an updated value(s) of the time during which the combustion operation of the engine is continued, and (tcomb, 0) is a current value(s) of the time during which the combustion operation of the internal combustion engine 100 is continued. Mathematical Formula 7 is a formula representing both a state immediately after the internal combustion engine 100 is stopped and a state in which the internal combustion engine 100 is stopped for a while. In addition, in the case of Mathematical Formula 7, since the value of tcomb (combustion operation duration) becomes negative when the time after the stop of the internal combustion engine is long, tcomb≥0 is set in principle.

Δτstop is a parameter for expressing a decrease in the piston temperature at the time of fuel cut or the time of engine stop as a decrease in the combustion operation duration of the internal combustion engine. That is, "−Δτstop" represents temperature decrease. In the simplest form, Δτstop may be set to the calculation period. In addition, since the decrease in the piston temperature is affected by the time of fuel cut, the time of engine stop, the water temperature, and the oil temperature, Δτstop can be given by a map having the water temperature, the oil temperature, and the engine speed as the axes. The Δτstop becomes larger as the water temperature and the oil temperature become smaller, and Δτstop can be made larger as the engine speed becomes larger. This is because the fact that the amount of energy flowing from the piston to the liner portion increases and the cooling progresses the smaller the water temperature and the oil temperature, and the fact that more heat transfer with the air introduced into the cylinder is performed and the cooling of the piston progresses under the condition of larger engine speed are reflected.

An initial value of the time during which the combustion operation is continued, which is necessary for calculating the time during which the combustion operation of the engine is continued, can be set based on the oil temperature and the water temperature at the time of engine start. For example, a reference value of the cooling water temperature is determined, and the initial value is set to 0 when the cooling water temperature at the start of engine combustion is at the reference value. On the other hand, when the cooling water temperature at the start of engine combustion is greater than or equal to the reference value, the initial value is set to a value larger than 0. On the contrary, when the cooling water temperature at the start of engine combustion is less than the reference value, the initial value is set to a value smaller than 0. With this setting, it is possible to reproduce a state in which there is a difference in time to reach a predetermined temperature due to a difference in initial temperature. Note that an initial value of the time during which the combustion operation is continued is also required to be determined in advance by simulation or an engine operation test.

(Still Another Calculation Method of Piston Temperature Correlation Index)

In the process in which the temperature of the piston rises, the amount of heat transfer to the piston increases the larger the engine output (e.g., engine torque or engine speed), and thus the temperature rise tends to become large. Furthermore, since there exists an energy flowing from the piston to the oil due to oil jet injection, the affect thereof may also be reflected as an index. In the combustion operation duration described above, it is difficult to reflect the operating condition and the oil jet operation state. Therefore, the formula regarding the combustion operation duration illustrated in Mathematical Formula 6 is improved, and an index having a correlation with the piston temperature is defined as the following Mathematical Formula 8. As a result, in Mathematical Formula 6, the operation time of the engine is simply integrated, but in Mathematical Formula 8, the operating condition and the influence of the oil jet can be reflected by weighting the operating condition and the presence or absence of the oil jet when integrating the operation time.

$$tcomb = (tcomb, 0) + (\alpha out - \alpha oj)\,\Delta\tau \qquad \text{[Mathematical Formula 8]}$$

(At time of combustion operation)

Here, tcomb is an updated value(s) of the index correlated with the piston temperature, (tcomb, 0) is a current value(s) of the index correlated with the piston temperature, and αout is a coefficient for reflecting the influence of the operating condition, and is an index having a positive correlation with the output. For example, the value of gout in the reference output may be set to 1, and αout may be set to a value having a positive correlation with the output. When the output is 0, the coefficient is set to a negative value. As a result, a change in which the piston temperature decreases at the time of engine stop and at the time of fuel cut can also be expressed. For example, when αout in a case where the output is 0 is set to −1, Mathematical Formula 8 is equivalent to Mathematical Formula 7. In addition, αoj is a coefficient for reflecting the influence of the oil jet, and is given as an index having a positive correlation with the oil jet flow rate or the hydraulic pressure. For example, when the oil jet flow rate is 0, αoj may be set to 0, and αoj may be set in a relationship proportional to the oil jet flow rate. Furthermore, when the value of αoj is given based on the hydraulic pressure, αoj may be set to 0 at a hydraulic pressure of less than the valve opening pressure of the valve 102, and αoj may be set in a positive correlation with the hydraulic pressure in a range where the hydraulic pressure is greater than or equal to the valve opening pressure. As a result, it is possible to apply an index that is closer to the behavior of the piston temperature as compared with the combustion operation duration (Mathematical Formula 6 to Mathematical Formula 7) and that can be easily calculated as compared with the piston temperature estimation (Mathematical Formula 1 to Mathematical Formula 5).

[Hydraulic Pressure Setting Unit]

The hydraulic pressure setting unit 42 (see FIG. 4) is a processing block that sets the oil pressure generated by the variable displacement type oil pump 54. The hydraulic pressure setting unit 42 sets a hydraulic pressure when oil jet injection is performed based on the piston temperature correlation index and an evaporation parameter (evaporable temperature, saturated vapor pressure, etc.) of fuel attached to the piston. The oil pressure is determined by a branch process illustrated in FIG. 7 based on the piston temperature correlation index, and as a result, the oil jet injection amount can be controlled. As described above, in the present embodiment, the oil jet injection amount can be controlled based on an index correlated with the piston temperature by providing the piston temperature correlation index estimation unit 41 and the hydraulic pressure setting unit 42.

The operation of the hydraulic pressure setting unit 42 of the internal combustion engine control device 20 will be described with reference to FIG. 7.

Figure 7:
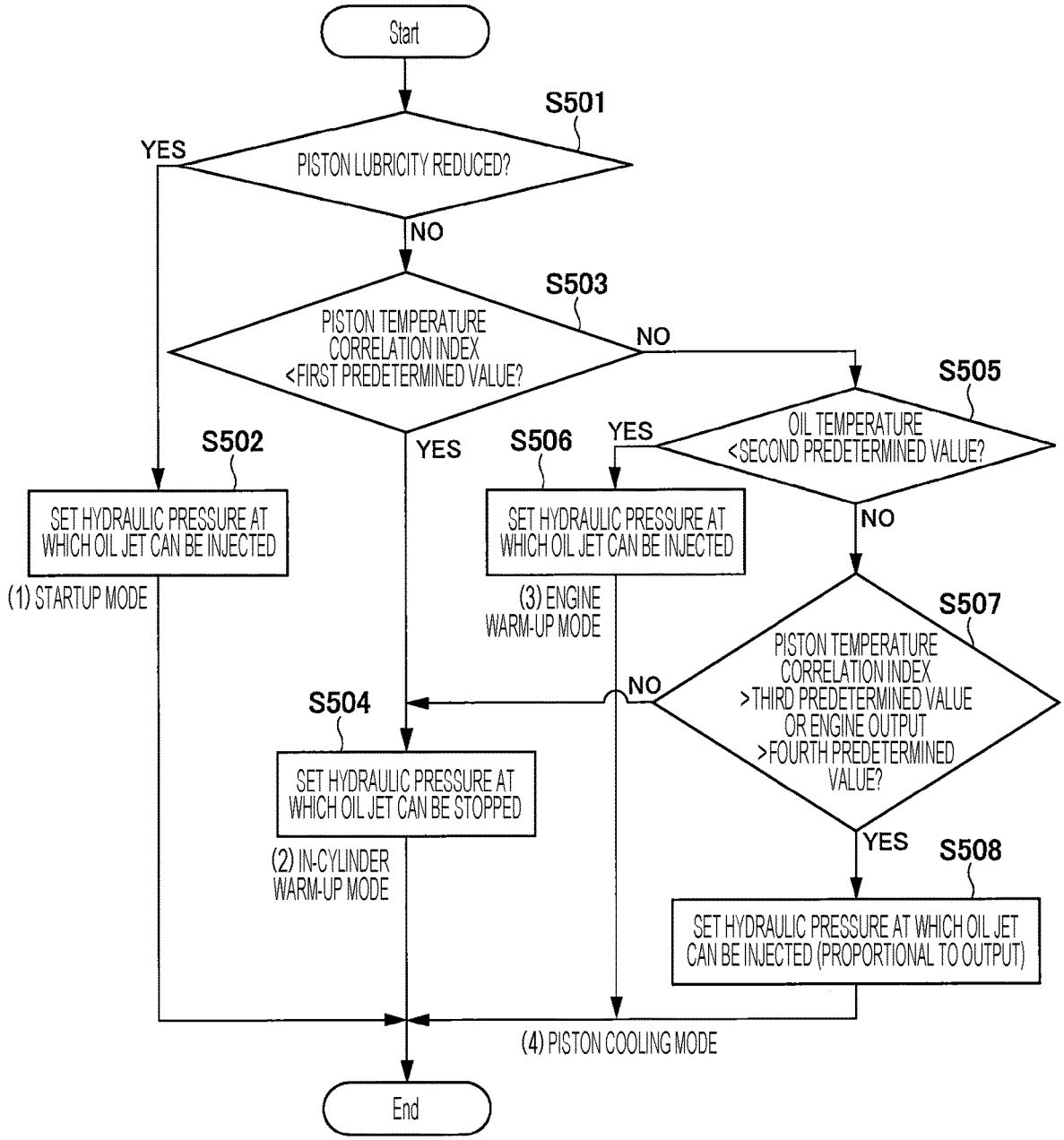
FIG. 7 is a flowchart illustrating an operation example of a hydraulic pressure setting unit of the internal combustion engine control device according to one embodiment of the present invention.

FIG. 7 is a flowchart illustrating an operation example of the hydraulic pressure setting unit 42 of the internal combustion engine control device 20.

First, in step S501, the hydraulic pressure setting unit 42 determines whether the piston lubricity is reduced, that is, whether the piston lubricity is low. For example, when the engine combustion operation duration calculated by Mathematical Formulas 6 and 7 is smaller than a predetermined value, determination can be made that the piston lubricity is low. If the determination in step S501 is YES, the hydraulic pressure setting unit 42 proceeds to step S502, and if the determination is NO, the hydraulic pressure setting unit proceeds to step S503.

In step S502, the hydraulic pressure setting unit 42 sets the target hydraulic pressure of the oil pump 54 to a hydraulic pressure that allows oil jet injection. The hydraulic pressure at which the oil jet can be injected is determined according to the specifications of the oil jet nozzle and the valve 102 (see FIG. 1) and the oil temperature. Qualitatively, the lower the oil temperature, the higher the hydraulic pressure at which the oil jet can be injected. The valve 102 is a check valve (check valve) configured to open when the hydraulic pressure of the oil main gallery 110 becomes greater than or equal to a predetermined value. For example, a ball valve can be used as the valve 102.

Here, the relationship between the oil temperature and the oil jet injectable pressure will be described with reference to FIG. 8.

Figure 8:
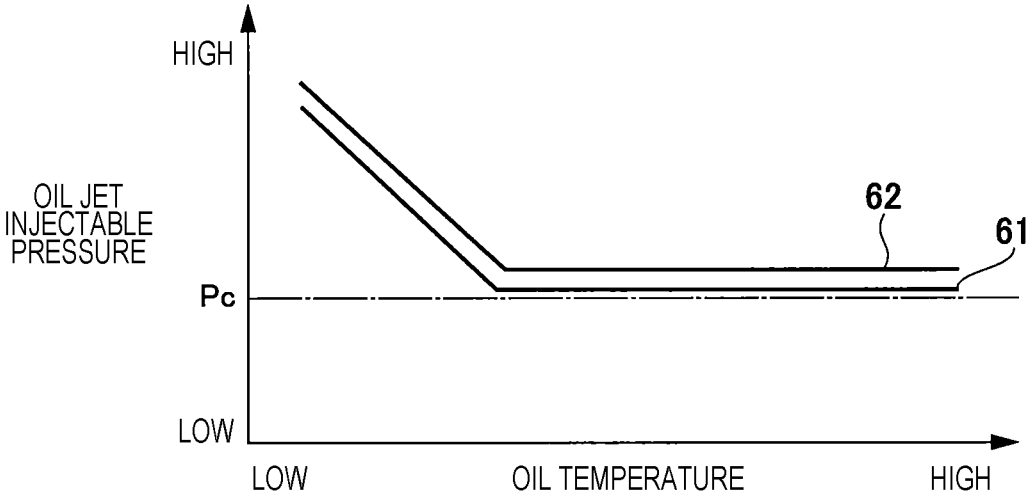
FIG. 8 is a map (graph) illustrating an example of a relationship between an oil temperature and an oil jet injectable pressure.

FIG. 8 is a map (graph) illustrating an example of a relationship between the oil temperature and the oil jet injectable pressure. In FIG. 8, the vertical axis represents the oil jet injectable pressure, and the horizontal axis represents the oil temperature.

As illustrated in FIG. 8, under the condition where the oil temperature is high, the injection pressure is determined by the valve opening pressure of the valve 102. At a low temperature, the oil viscosity increases, and hence the pressure loss in the oil jet nozzle increases, whereby the pressure required to eject the oil from the nozzle tip may become extremely larger than the injection pressure (oil jet cut pressure Pc) determined by the valve 102. The hydraulic pressure setting unit 42 determines a set value of the hydraulic pressure (target hydraulic pressure 62) based on the oil temperature at the current time point and the relationship illustrated in FIG. 8. The target hydraulic pressure 62 may be set to a value greater than or equal to the pressure at which the oil jet can be injected (the oil jet injectable pressure 61). Hereinafter, the mode in which the process in step S502 is performed is referred to as "startup mode (1)".

With this setting, the hydraulic pressure setting unit 42 can determine a case where the piston lubricity is low, and can set the hydraulic pressure at which the oil jet can be injected. Therefore, by improving the lubricity by supplying the oil by the oil jet under the condition in which the piston lubricity is low, the deterioration of the fuel consumption in the situation of low piston lubricity can be reduced.

As described above, the hydraulic pressure setting unit 42 is configured to set the target value of the hydraulic pressure of the oil jet (the oil jet system 101) to the hydraulic pressure at which the oil jet can be injected, and to set the hydraulic pressure at which each part of the internal combustion engine can be impregnated with the oil.

In addition, the hydraulic pressure setting unit 42 sets a target value of the hydraulic pressure of the oil jet (the oil jet system 101) to the hydraulic pressure at which the oil jet injection can be stopped or the hydraulic pressure at which the oil jet can be injected based on the hydraulic pressure at which the valve 102, which responds to the hydraulic pressure provided between the oil pump 54 and the oil jet nozzle, is opened and closed.

In step S503 of FIG. 7, the hydraulic pressure setting unit 42 determines whether the piston temperature correlation index is smaller than a first predetermined value. The first predetermined value can be determined based on the fuel evaporable condition. For example, when the piston temperature correlation index is the piston temperature estimation value, values equivalent to the 10% distillation temperature, the 30% distillation temperature, and the like corresponding to the evaporation start temperature can be designated as the predetermined value. When the combustion operation duration of the internal combustion engine 100 is used as the piston temperature correlation index, the value of the index when the piston temperature rises to about 10% distillation temperature and 30% distillation temperature corresponding to the distillate start temperature can be measured in advance by simulation or experiment and determined as the first predetermined value. This setting method is based on the idea that when the piston temperature is greater than or equal to the evaporable temperature, heating due to heat transfer from the combustion gas and the air-fuel mixture in the cylinder is also received, and thus the piston temperature may be in a temperature range that does not inhibit fuel vaporization.

As described above, when the piston temperature correlation index is less than the first predetermined value determined based on the temperature corresponding to the fuel evaporable condition as the evaporation parameter, the hydraulic pressure setting unit 42 sets the hydraulic pressure of the oil jet (oil jet system 101) to the hydraulic pressure at which the oil jet injection can be stopped.

When the piston temperature correlation index is smaller than the first predetermined value (determination of YES in S503), the hydraulic pressure setting unit 42 proceeds to step S504. Furthermore, when the piston temperature correlation index is greater than or equal to the first predetermined value (determination of NO in S503), the process proceeds to step S505.

In step S504, the hydraulic pressure setting unit 42 sets the target hydraulic pressure of the oil pump 54 to the hydraulic pressure at which the oil jet can be stopped based on the relationship illustrated in FIG. 8. Specifically, the pressure may be set to be lower than the valve opening pressure of the valve 102 provided between the oil main gallery 110 and the oil jet nozzle. Hereinafter, the mode in which the process in step S504 is performed is referred to as an "in-cylinder warm-up mode (2)".

With this setting, when the piston temperature is lower than the evaporation start temperature and vaporization of the fuel attached to the piston is suppressed, the hydraulic pressure can be set to a hydraulic pressure at which the oil jet injection can be stopped. Therefore, the internal combustion engine control device 20 can promote the rise in the piston temperature by stopping the oil jet and suppressing the energy flowing from the piston to the oil under a low condition in which the vaporization of the fuel attached to the piston is suppressed. As a result, the time until the piston temperature reaches the evaporation start temperature of the fuel can be shortened. Therefore, unburned hydrocarbon and particulate matter which are harmful emission components discharged due to piston attachment can be reduced.

In step S505, the hydraulic pressure setting unit 42 determines whether the oil temperature is lower than the second predetermined value. The second predetermined value may be a reference value at which the oil temperature is regarded as the warm-up state. For example, the oil temperature at which the friction loss becomes sufficiently low may be ascertained and determined from an experiment or a simulation. If the determination in step S505 is YES, the process proceeds to step S506, and if the determination is NO, the process proceeds to step S507.

In step S506, the hydraulic pressure setting unit 42 sets the target hydraulic pressure of the oil pump 54 to a hydraulic pressure at which the oil jet can be injected. With this setting, an operation of starting the oil jet after the piston temperature rises can be performed. Hereinafter, the mode in which the process in step S506 is performed is referred to as an "engine warm-up mode (3)".

Thus, after the piston temperature rises to a temperature required for evaporation of the fuel, a part of the energy flowing to the piston can be flowed to the oil. Therefore, the rise in the oil temperature can be promoted without impairing the vaporization of the fuel attached to the piston. As a result, fuel consumption deterioration caused by a low oil temperature can be reduced.

As described above, when the piston temperature correlation index is greater than or equal to the first predetermined value, the hydraulic pressure setting unit 42 sets the target value of the hydraulic pressure of the oil jet to the hydraulic pressure at which the oil jet can be injected when the oil temperature of the oil jet (oil jet system 101) is less than the second predetermined value regarded as the warm-up state.

Furthermore, in order to further obtain the above effect, the hydraulic pressure setting unit 42 preferably sets the hydraulic pressure in a range in which the oil jet can be injected within a range in which the piston temperature correlation index does not become lower than the first predetermined value. When the piston temperature is used as the piston temperature correlation index, the piston temperature is predicted under two levels of oil jet injection conditions using Mathematical Formula 9 to Mathematical Formula 11, and the oil jet flow rate in a range not less than the first predetermined value may be determined based on the predicted value.

$$\text{Tpis_1} = (Tpis, 0) + (Qinp - (Qout, 1) - (Qout, \text{oj_1}) - (Qout, res)) \div (Mpis \times Cpis) \quad \text{[Mathematical Formula 9]}$$

$$\text{Tpis_2} = (Tpis, 0) + (Qinp - (Qout, 1) - (Qout, \text{oj_2}) - (Qout, res)) \div (Mpis \times Cpis) \quad \text{[Mathematical Formula 10]}$$

$$\text{Moj_tar} = (\text{Moj_2} - \text{Moj_1}) \div (\text{Tpis_2} - \text{Tpis_1}) \times (\text{first predetermined value} + \Delta Tpis - \text{Tpis_1}) + \text{Moj_1} \quad \text{[Mathematical Formula 11]}$$

Here, Tpis_1 is an estimated value of the piston temperature when the hydraulic pressure is set to level 1, and Tpis_2 is an estimated value of the piston temperature when the hydraulic pressure is set to level 2. Further, Moj_1 is an oil jet flow rate at the hydraulic pressure of level 1, Moj_2 is an oil jet flow rate at the hydraulic pressure of level 2, and ΔTpis is a margin from a first predetermined value of the piston temperature correlation index. Here, the estimated values of the piston temperatures of level 1 and level 2 may be different values. How to give numerical values necessary for the calculation of Mathematical Formula 9 and Mathematical Formula 10 is the same as in Mathematical Formula 1. The oil jet flow rate target value Moj_tar is calculated from the calculated Tpis_1 and Tpis 2. After the oil jet flow rate target value Moj_tar is calculated, the target hydraulic pressure can be determined from the relationship between the oil hydraulic pressure and the oil jet flow rate in FIG. 5.

When the combustion operation duration is used as the piston temperature correlation index, the oil jet flow rate target value Moj_tar at which the operation measurement time is a value having a predetermined margin (e.g., Δtcomb) from the first predetermined value is calculated. An example is shown in Mathematical Formula 12. Calpha is the proportionality factor between the oil jet flow rate and the αoj, given that the αoj is proportional to the oil jet flow rate (αoj=Calpha×oil jet flow rate). After the oil jet flow rate target value Moj_tar is calculated, the target hydraulic pressure can be determined from the relationship between the oil hydraulic pressure and the oil jet flow rate in FIG. 5.

$$\text{Moj_tar} = [\{(tcomb, 0) - \text{first predetermined value} - \Delta tcomb\} \div \Delta\tau + \alpha out] \div Calpha \quad \text{[Mathematical Formula 12]}$$

With the hydraulic pressure in step S506 set by such a method, the rise in the oil temperature can be promoted while preventing the piston temperature from falling below the evaporable temperature. As a result, deterioration of exhaust performance can be prevented, and oil temperature rise can be maximized.

Note that the oil jet can be injected in a state where the piston temperature is maintained at a temperature greater than or equal to the evaporable temperature by providing the engine warm-up mode (3). Therefore, as compared with a state in which the oil jet is completely stopped and the piston temperature rise is accelerated, the rise in the oil temperature and the fuel consumption deterioration can be suppressed while suppressing the deterioration in the exhaust performance to the minimum, and the utilization efficiency of the combustion energy can be enhanced.

As described above, when setting the hydraulic pressure of the oil jet (oil jet system 101) to the hydraulic pressure at which the oil jet can be injected (engine warm-up mode), the hydraulic pressure setting unit 42 sets the hydraulic pressure of the oil jet to the hydraulic pressure that realizes the oil jet injection amount in a range in which the piston temperature does not decrease due to the energy flowing to the oil by the oil jet injection.

In step S507, whether the piston temperature correlation index is higher than a third predetermined value or the engine output is higher than a fourth predetermined value is determined. If determined YES in step S507, the process proceeds to step S508, and if determined NO, the process proceeds to step S504. Note that the third predetermined value can be defined as a condition that the piston temperature is high and abnormal combustion (knocking) occurs. Furthermore, the fourth predetermined value can be determined by an engine output range in which knocking occurs. The relationship between piston temperature and knocking is illustrated in FIG. 9.

Figure 9:
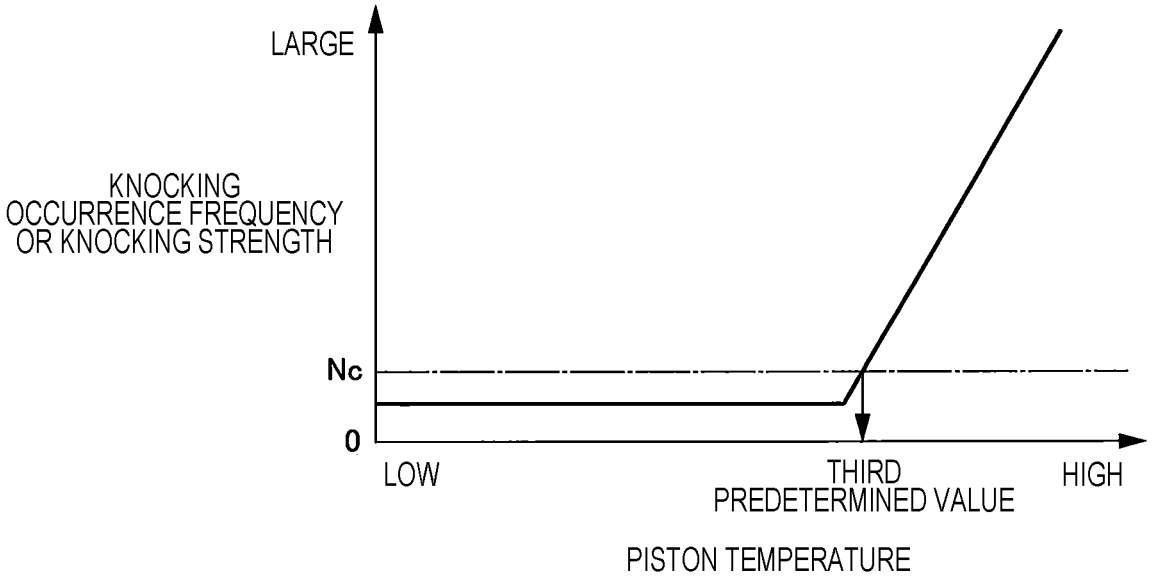
FIG. 9 is a diagram illustrating a correlation between a piston temperature and a knocking occurrence frequency or knocking strength.

FIG. 9 is a diagram illustrating a correlation between the piston temperature and the occurrence frequency of knocking or the strength of knocking. In FIG. 9, the vertical axis represents the knocking occurrence frequency (or knocking strength), and the horizontal axis represents the piston temperature.

The example of FIG. 9 is a correlation assumed to be measured at the same engine output point. As the piston temperature rises, knocking starts to occur. As the piston temperature rises, the occurrence frequency and strength of the knocking increase. Therefore, the third predetermined value can be determined such that the occurrence frequency and the strength of knocking fall within a sufficiently small range. In the case of the piston temperature, the temperature under the condition where the occurrence frequency or strength of knocking is small (knocking index Nc) is set. In the other indexes, the value of the index in a state where the piston temperature is reached is set as the third predetermined value.

Figure 10:
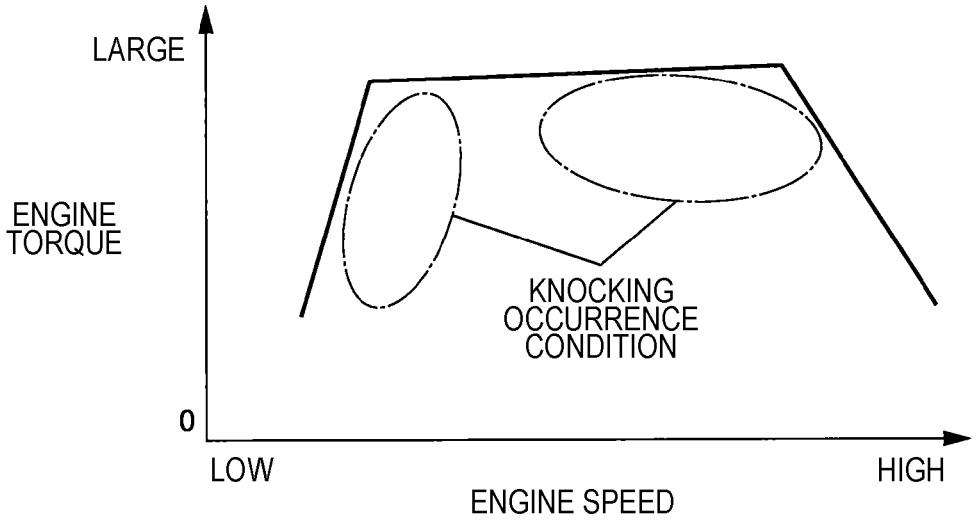
FIG. 10 is a diagram illustrating knocking occurrence conditions on a map having the engine speed and the engine torque as axes.

FIG. 10 is a diagram illustrating knocking occurrence conditions on a map having the engine speed and the engine torque as axes. In FIG. 10, the vertical axis represents the engine torque, and the horizontal axis represents the engine speed.

Knocking is likely to occur under conditions of low rotation and high load and high rotation and high load. In view of these tendencies, the fourth predetermined value may be set so as to be changeable depending on the engine speed. Since the knocking occurrence condition depends on the specifications of the internal combustion engine 100, the knocking occurrence condition is desirably set in advance based on the engine operation test.

In step S508 of FIG. 7, the hydraulic pressure setting unit 42 sets the target hydraulic pressure of the oil pump 54 to a hydraulic pressure at which the oil jet can be injected. It is desirable to set the hydraulic pressure so as to have a positive correlation with the engine output, and to set the hydraulic pressure higher as the engine output becomes higher. That is, it is desirable to set such that the oil jet flow rate increases as the engine output becomes higher. The mode in which the process in step S508 is performed is referred to as a "piston cooling mode (4)". This makes it possible to efficiently suppress knocking that occurs when the piston temperature becomes higher and knocking that occurs under a high output condition, and to improve thermal efficiency in the engine.

As described above, when the oil temperature of the oil jet is greater than or equal to the second predetermined value, the hydraulic pressure setting unit 42 sets the target value of the hydraulic pressure of the oil jet (oil jet system 101) in conjunction with the operating condition parameter (e.g., the engine output).

Then, after the processes of steps S502, S504, S506, or S508, the operation of the hydraulic pressure setting unit 42 is ended.

As described above, the internal combustion engine control device 20 (ECU) according to the present embodiment appropriately operates the oil jet injection amount by operating the hydraulic pressure of the oil jet in view of the operating condition affecting the wall surface temperature of the piston and the piston temperature. Thus, the amount of energy flowing to the piston or the engine oil can be operated. In other words, the internal combustion engine control device 20 controls the oil jet flow rate by operating the hydraulic pressure based on a predetermined value set based on phenomena such as fuel vaporization, oil viscosity, and abnormal combustion. Therefore, the energy generated by combustion can be efficiently supplied to a necessary place, the energy utilization efficiency of the engine system can be increased, and the exhaust performance and the fuel consumption performance can be improved.

[Operation of Various Parameters]

Next, the operation of various parameters by the hydraulic pressure control of the internal combustion engine control device 20 according to the present embodiment will be described with reference to FIG. 11.

Figure 11:
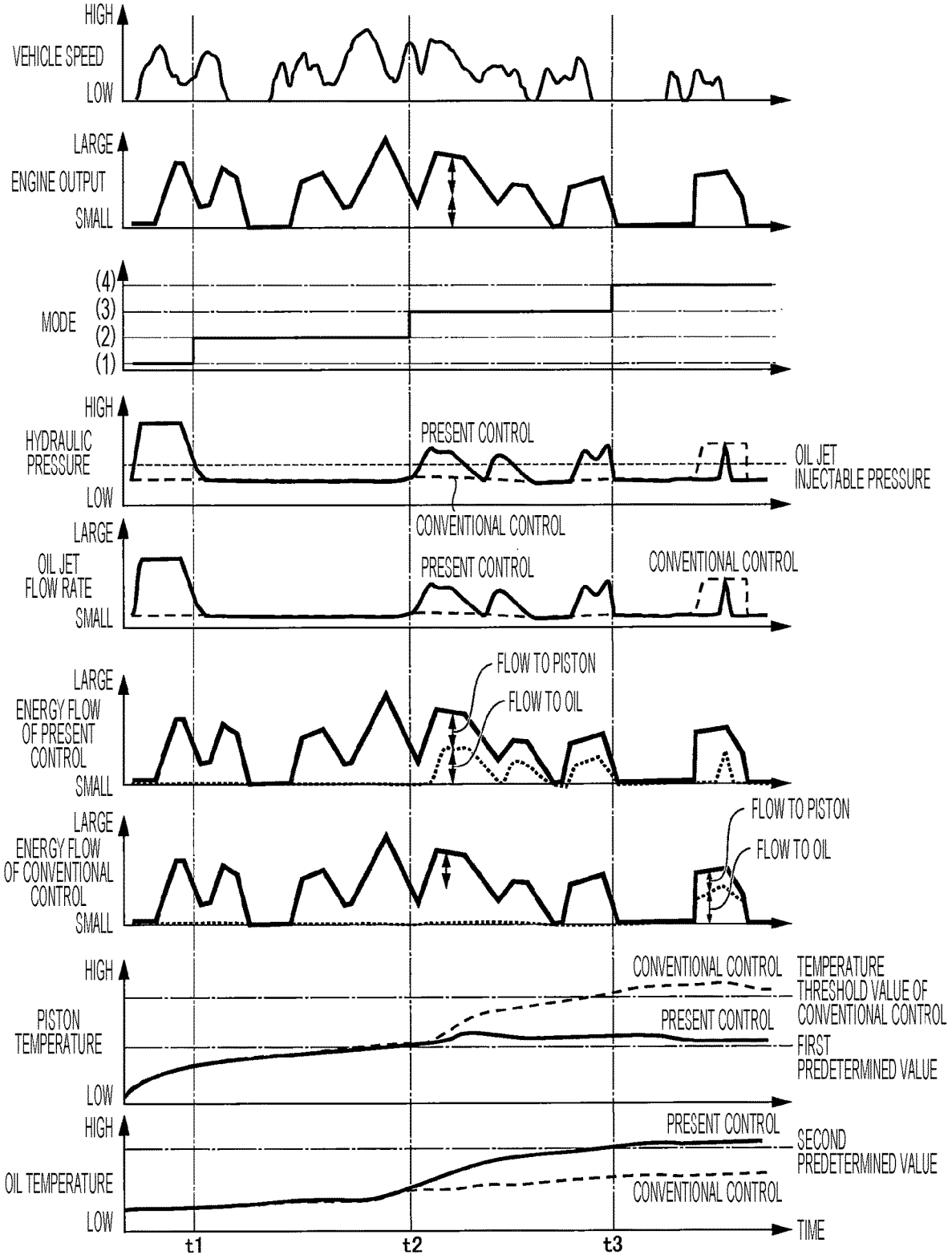
FIG. 11 is a timing chart illustrating an operation example of various parameters by hydraulic pressure control of the internal combustion engine control device according to one embodiment of the present invention.

FIG. 11 is a timing chart illustrating an operation example of various parameters when the internal combustion engine control device 20 performs the hydraulic pressure control process illustrated in FIG. 7. FIG. 11 illustrates, as parameters, a vehicle speed, an engine output, a hydraulic pressure setting mode, a hydraulic pressure, an oil jet flow rate, an energy flow of the present control, an energy flow of the conventional control, a piston temperature, and an oil temperature. In the drawing, in an operation other than the energy flow, a solid line indicates control (main control) according to the present embodiment, and a broken line indicates conventional control. As the conventional control, it is assumed that a hydraulic pressure at which the oil jet can be injected is set when the piston temperature rises to a threshold value in the conventional control.

In the example illustrated in FIG. 11, after the engine is started, the startup mode (1) starts and results of transitions to the in-cylinder warm-up mode (2) at time t1, the engine warm-up mode (3) at time t2, and the piston cooling mode (4) at time t3 are shown. In an initial state where the lubrication performance is insufficient, the oil is supplied to the piston by moving in the startup mode (1), and the lubricity is improved.

After time t1 at which the piston lubricity is secured, the operation of the in-cylinder warm-up mode (2) starts, and the hydraulic pressure is lowered below the oil jet injectable pressure. As a result, the energy transmitted from the combustion gas to the piston is maximally utilized for piston heating to increase the piston temperature rise speed.

After time t2 at which the piston temperature reaches a first predetermined value, which is an index correlated with the evaporable temperature, the operation of the engine warm-up mode (3) starts, and the hydraulic pressure is increased to a value larger than the oil jet injectable pressure. In addition, by making the hydraulic pressure variable according to the operating situation of the internal combustion engine 100, the amount of heat flowing to the oil can be increased while maintaining the piston temperature around the first predetermined value. As a result, as shown in the change in the energy flow, a part of the energy used for the piston temperature rise in the conventional control can be flowed to the oil. As a result, the oil temperature can be raised as compared with the conventional control. Therefore, the period in the low oil temperature state can be shortened, and reduction of the friction loss can be realized. In addition, since the oil temperature can be efficiently raised while maintaining the piston temperature and suppressing deterioration in exhaust performance, both improvement in exhaust performance and reduction in friction loss can be achieved.

After time t3 at when the oil temperature becomes greater than or equal to the second predetermined value, the operation is performed in the engine warm-up mode (3) or the piston cooling mode (4) according to the piston temperature correlation index. In this example, a setting is illustrated in which the hydraulic pressure is operated such that the oil jet flow rate corresponding to the output is blown under the condition that the engine output is increased.

As described above, by setting various predetermined values (first predetermined value to fourth predetermined value) based on phenomena such as fuel vaporization, oil viscosity, and abnormal combustion, it is possible to set a hydraulic pressure that realizes an appropriate oil jet flow rate according to the piston temperature, oil temperature, and output of the engine, and to efficiently supply the energy generated by combustion to a necessary place. As a result, the energy utilization efficiency of the engine system including the internal combustion engine 100 can be increased, and the exhaust performance and the fuel consumption performance can be improved.

Note that the setting of the target hydraulic pressure may be determined based on operation requests of various components or other requests. Therefore, the present invention does not exclude the possibility that the target hydraulic pressure is eventually overwritten by a value determined by a different requirement from the example illustrated in the one embodiment described above.

Furthermore, the present invention is not limited to the one embodiment described above, and it goes without saying that various other application examples and modifications can be taken without departing from the gist of the present invention described in the claims. For example, in the embodiment described above, the configuration of the internal combustion engine control device has been described in detail and specifically in order to describe the present invention in an easy-to-understand manner, and the embodiment is not necessarily limited to one including all the components described above. In addition, it is also possible to add, replace, or delete other components for a part of the configuration of one embodiment.

In addition, some or all of the above-described configurations, functions, processing units, and the like may be realized by hardware, for example, by designing with an integrated circuit. A processor device in a broad sense such as a field programmable gate array (FPGA) or an application specific integrated circuit (ASIC) may be used as the hardware.

Furthermore, in the flowchart describing the time-series processes illustrated in FIG. 7, a plurality of processes may be executed in parallel or the processing order may be changed within a range not affecting the processing result.

In addition, in the above-described embodiment, control lines and information lines considered to be necessary for description are illustrated, and not all control lines and information lines are necessarily illustrated in terms of products. In practice, it may be considered that almost all the components are connected to each other.

REFERENCE SIGNS LIST

20 internal combustion engine control device
26 oil jet control unit
41 piston temperature correlation index estimation unit
42 hydraulic pressure setting unit
54 oil pump
61 oil jet injectable pressure
62 target hydraulic pressure
100 internal combustion engine
101 oil jet system
102 valve
110 oil main gallery
111 hydraulic sensor
171 oil control valve
Pc oil jet cut pressure

The invention claimed is:

1. An internal combustion engine control device provided with a variable displacement type oil pump, an oil jet for injecting oil discharged from the oil pump to a back surface of a piston of an internal combustion engine, and a valve that is responsive to a hydraulic pressure of the oil pump and provided between the oil pump and the oil jet, and controlling the valve via the hydraulic pressure of the oil pump, the internal combustion engine control device comprising:

a correlation index estimation unit configured to estimate a piston temperature correlation index correlated with a temperature of the piston based on an operating condition parameter of the internal combustion engine the hydraulic pressure of the oil pump, and an oil temperature of the oil; and a hydraulic pressure setting unit configured to set a hydraulic pressure of the oil pump, based on the piston temperature correlation index, an evaporation parameter of fuel attached to the piston, and an oil jet injectable pressure, which is a threshold value of a hydraulic pressure at which the valve is caused to open and the injection of the oil is enabled, wherein when the piston temperature correlation index is less than a first predetermined value determined based on a temperature corresponding to a fuel evaporable condition as the evaporation parameter, the hydraulic pressure setting unit sets a target value of the hydraulic pressure of the oil pump to a hydraulic pressure that is less than the oil jet injectable pressure, wherein when the piston temperature correlation index is greater than or equal to the first predetermined value, and the oil temperature of the oil is less than a second predetermined value regarded as being in the warm-up state, the hydraulic pressure setting unit sets the hydraulic pressure of the oil pump to a hydraulic pressure greater than or equal to the oil jet injectable pressure, and wherein the hydraulic pressure setting unit makes an estimate of the piston temperature correlation index when setting the hydraulic pressure of the oil pump to the hydraulic pressure equal to or greater than the oil jet injectable pressure, and based on the estimate, determines a target value of the hydraulic pressure of the oil pump within a range that the piston temperature correlation index does not fall below the first predetermined value.

2. The internal combustion engine control device according to claim 1, wherein when the piston temperature correlation index is greater than or equal to the first predetermined value, and the oil temperature of the oil is greater than or equal to the second predetermined value, the hydraulic pressure setting unit sets a target value of the hydraulic pressure of the oil pump in conjunction with the operating condition parameter.

3. The internal combustion engine control device according to claim 1, wherein the hydraulic pressure setting unit determines the oil jet injectable pressure according to a present oil temperature of the oil, and when the present oil temperature of the oil is low and an oil viscosity of the oil increases, sets the oil jet injectable pressure such that the oil jet injectable pressure increases more than when the present oil temperature of the oil is high and the oil viscosity of the oil decreases.

4. A control method of an internal combustion engine provided with a variable displacement type oil pump, an oil jet for injecting oil discharged from the oil pump to a back surface of a piston of an internal combustion engine, and a valve that is responsive to a hydraulic pressure of the oil pump and provided between the oil pump and the oil jet, and controlling the valve via the hydraulic pressure of the oil pump, the control method of an internal combustion engine comprising:

a correlation index estimating process of estimating a piston temperature correlation index correlated with a temperature of the piston based on an operating condition parameter of the internal combustion engine, the hydraulic pressure of the oil pump, and an oil temperature of the oil; and a hydraulic pressure setting process of setting a hydraulic pressure of the oil pump, based on the piston temperature correlation index, an evaporation parameter of fuel attached to the piston, and an oil jet injectable pressure, which is a threshold value of a hydraulic pressure at which the valve is caused to open and the injection of the oil is enabled, wherein when the piston temperature correlation index is less than a first predetermined value determined based on a temperature corresponding to a fuel evaporable condition as the evaporation parameter, the hydraulic pressure setting process sets a target value of the hydraulic pressure of the oil pump to a hydraulic pressure that is less than the oil jet injectable pressure, when the piston temperature correlation index is greater than or equal to the first predetermined value, and the oil temperature of the oil is less than a second predetermined value regarded as being in the warm-up state, the hydraulic pressure setting process sets the hydraulic pressure of the oil pump to a hydraulic pressure greater than or equal to the oil jet injectable pressure, and the hydraulic pressure setting process makes an estimate of the piston temperature correlation index when setting the hydraulic pressure of the oil pump to the hydraulic pressure equal to or greater than the oil jet injectable pressure, and based on the estimate, determines a target value of the hydraulic pressure of the oil pump within a range that the piston temperature correlation index does not fall below the first predetermined value.

* * * * *